US005908209A

United States Patent [19]

Carides et al.

[11] Patent Number: 5,908,209

[45] Date of Patent: Jun. 1, 1999

[54] MULTI-PLY LABELS HAVING COLLECTABLE COMPONENTS

[75] Inventors: James J. Carides, Lawrenceville; Mark D. Davis, Alpharetta; Robert L. Everett, Sugar Hill; Polly C. Hopkins, Lilburn; James T. Pittman, Lula; Benny R. Rich, Gainesville; Rodney E. Stephens, Suwanee, all of Ga.

[73] Assignee: Dittler Brothers Incorporated, Atlanta, Ga.

[21] Appl. No.: 09/038,739

[22] Filed: Mar. 11, 1998

[51] Int. Cl.[6] ..... B42F 3/02

[52] U.S. Cl. ..... 283/81; 283/101; 283/103; 283/105

[58] Field of Search ..... 283/81, 101, 103, 283/105

[56] References Cited

U.S. PATENT DOCUMENTS

| | | | |
|---|---|---|---|
| 4,174,857 | 11/1979 | Koza | 283/6 |
| 4,621,837 | 11/1986 | Mack | 283/105 |
| 4,910,058 | 3/1990 | Jameson | 283/101 |
| 5,653,473 | 8/1997 | Laszutko et al. . | |
| 5,720,499 | 2/1998 | Sakashita | 283/105 |
| 5,766,716 | 6/1998 | Barry | 283/40.1 |
| 5,792,536 | 8/1998 | Whipp | 283/103 |

*Primary Examiner*—Andrea L. Pitts
*Assistant Examiner*—Rouzbeh Tabaddor
*Attorney, Agent, or Firm*—Dean W. Russell; Geoff L. Sutcliffe; Kilpatrick Stockton LLP

[57] ABSTRACT

A label according to the invention reduces waste, has a lower cost, yet maintains a high level of consumer friendliness. In one embodiment, a label according to the invention uses adhesive rails in order to reduce the amount of adhesive and also places a confusion on a release layer in order to eliminate a downsheet. According to another embodiment, a label has a first layer of pressure sensitive adhesive for securing the label to a substrate but has a second layer of adhesive formed of a remoistenable gum to allow the consumer to later secure a collectable component to another substrate. In a further embodiment of the invention, a collectable component of a label has a release placed on one portion of its outer side and a repositionable adhesive placed on a second portion of its outer side. This label is consumer friendly in that it uses a pressure sensitive adhesive and since it allows a consumer to fold the collectable component in half before securing it to another substrate. In a further embodiment, a label is formed of two layers of paper and is secured to a substrate with a release liner placed between the collectable component and the substrate. The user may remove the collectable component from its substrate and then remove the liner when the consumer is ready to place the component on another substrate.

24 Claims, 9 Drawing Sheets

MULTI-PLY LABELS HAVING COLLECTABLE COMPONENTS

FIELD OF THE INVENTION

This invention relates generally to multi-ply labels and, more particularly, to multi-ply labels having components for collection or redemption.

BACKGROUND OF THE INVENTION

Many fast food restaurants as well as other retailers have games, promotions, giveaways, or other such events in order to lure customers into purchasing their goods. Oftentimes, labels are secured to the goods and the customers must purchase the goods in order to participate in the game. The game piece itself is typically hidden from view within the label and the customer must remove part or all of the label in order to view the game piece. The game piece may be a collectable item in which the customer tries to collect an entire set or the game piece may be redeemed to the vendor, for instance, in order to receive free goods or prizes.

An example of a label having such a game piece is shown and described in U.S. Pat. No. 5,653,473 to Laszutko et al., which is hereby incorporated by reference. With reference to FIGS. 1A to 1C, a label 10 described in the Laszutko et al. patent includes a first label composite 20 and a second label composite 22. The first label composite 20 includes a face layer 26 and a release layer 27 which is formed of a liner 28 and a release coating 29. The face layer 26 and release layer 27 are laminated together with a pressure-sensitive adhesive layer 30. The second label composite 22 also includes a face layer 34 and a release layer 35 which is formed of a liner 36 and release coating 38. The face layer 34 is laminated to the release layer 35 with a pressure-sensitive adhesive layer 40. The first and second label composites 20 and 22 are laminated together with an adhesive 42 and are positioned relative to each other so that surface 52 of the face layer 26 is in contact with surface 54 of face layer 34. The adhesive 42 is applied between the label composites 20 and 22 only in adhesive bar sections 14.

In use, the release layer 27 is peeled away from the rest of the label 10 and the face layer 26 is secured to a substrate with the pressure-sensitive adhesive layer 30 with this substrate, in one example, being a beverage cup. A customer who purchases the cup having the label 10 pulls a tab section 12 of the label 10 in order to separate the second label composite 22 from the face layer 26 of the first label composite 22. The label 10 has perforations 43 which are formed entirely through the second label composite 22 and partially through the first label composite 20 in order to assist in the removal of the second label composite 22. A front 54 of the face layer 34 may include printing in order to form the collectable component of the label 10. If desired, the customer may remove the release layer 35 to expose the adhesive layer 40 and then secure the collectable component to a game board or other surface. The second label composite 22 includes a cut line 45 to assist in the removal of the release layer 35 from the adhesive layer 40.

A typical label, such as label 10 shown in the Laszutko patent, is relatively expensive to manufacture. The label is generally a four-ply label with two of the plies being made from glossy paper stock and the other two plies being release layers, which may be formed of conventional paper or polymer stock coated with a release agent. The label also includes two complete layers of a pressure-sensitive adhesive. All of these layers and materials are rather expensive. A layer of the pressure-sensitive adhesive, for instance, is actually more expensive than one of the plies of paper, such as roughly 1.5 times the cost of the paper. A release layer is even more expensive than both the paper and the pressure-sensitive adhesive with its cost being approximately three times that of a single ply of paper. The use of two release layers and two layers of the pressure-sensitive adhesive therefore substantially increases the cost of the label.

In addition to expense, other problems of a typical label relate to its consumer friendliness. Some of the conventional labels have been difficult to remove from the supporting substrate, such as a beverage cup. When the customer attempts to remove the label, the customer inadvertently tears or otherwise damages the label itself. Once removed, customers have had difficulty in handling the labels or game pieces. For example, some game pieces are difficult to collect since they are not easily secured to a game board. Other game pieces, in contrast, have an adhesive layer exposed once the game piece is removed from the cup. These game pieces, however, are undesirable since the customer must immediately secure the game piece to the game board, which may have been left at home or at a different location.

SUMMARY OF THE INVENTION

A label according to the invention reduces waste, has a lower cost, yet maintains a high level of consumer friendliness. In one embodiment, a label according to the invention is formed of two layers of paper and is secured to a substrate with adhesive rails. The two layers are held together with a pressure sensitive adhesive and a release layer is positioned between the layers so that they may be selectively removed from each other. The label has a reduced amount of adhesive due to the use of adhesive rails and only places two layers of paper on the substrate, resulting in a reduced cost and reduced waste. After the collectable component has been removed, the consumer may remove and separate the two layers and secure the collectable component to a game board or other surface.

According to a second embodiment, a label is formed of three paper layers with the inner layer secured to a substrate with a pressure sensitive adhesive. The outer two layers are secured to each other and to the inner layer with adhesive rails and consequently use a reduced amount of adhesive. With less adhesive, the label has a reduced cost. The label maintains consumer friendliness by placing a remoistenable gum on the back side of the collectable component allowing the consumer to later secure it to a game board or other substrate.

In a third embodiment of the invention, a label has three paper layers with the inner layer secured to a substrate with a pressure sensitive adhesive. The outer two layers are secured to each other and to the inner layer with adhesive rails and consequently use a reduced amount of adhesive in order to reduce the label's overall cost. The back side of the collectable component has a release coating placed on one portion and a repositionable adhesive placed on a second portion. This label is consumer friendly in that the consumer can fold the collectable component in half for transporting the collectable component and can later open it and secure it to another substrate. The first layer has a release and repositionable adhesive for mating with the adhesive and release of the collectable component so as to allow the consumer to releasably secure the collectable component to the first layer.

In a fourth embodiment, a label is formed of two layers of paper secured to each other with adhesive rails. The inner substrate is secured to a substrate with a pressure sensitive adhesive. The label has reduced waste and cost since it only places two layers of paper on the substrate and only has one complete layer of adhesive. The label contains a collectable component in a perforated inner portion of the inner ply. When the collectable component is removed from the substrate, a liner aligned with the collectable component and placed between the collectable component and the substrate is removed along with the collectable component. As a result, the label is consumer friendly in that the user can remove the liner at a desired time and place the collectable component on a game board or other substrate.

Accordingly, it is an object of the present invention to provide a label that is easily secured to a substrate.

It is another object of the present invention to provide a label that is less expensive to manufacture.

It is a further object of the present invention to provide a label that has a high level of consumer friendliness.

It is a further object of the present invention to provide a label that has a component which is easily collected.

It is still another object of the present invention to provide a label that has a reduced number of layers.

It is yet another object of the present invention to provide a label that provides security for a hidden game piece.

It is still another object of the present invention to provide a label that reduces waste.

BRIEF DESCRIPTION OF THE DRAWINGS

The accompanying drawings, which are incorporated in and form a part of the specification, illustrate preferred embodiments of the present invention and, together with the description, serve to explain the principles of the invention. In the drawings.

DETAILED DESCRIPTION OF THE INVENTION

Figure 1B:
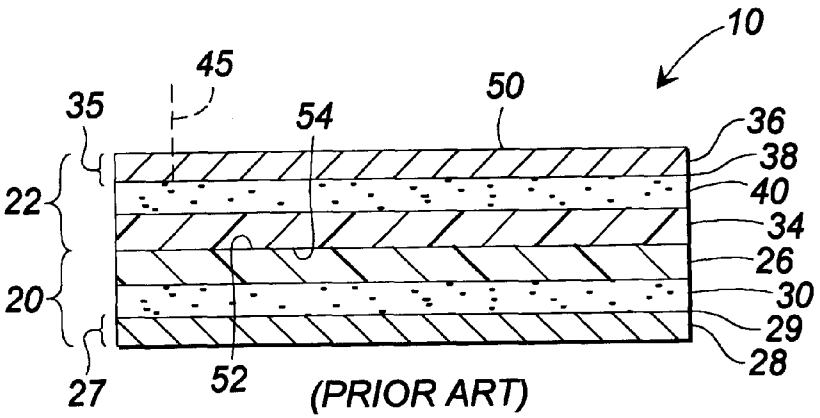
(PRIOR ART) FIG. 1B
FIG. 1A is a front view of a conventional label and FIGS. 1B and 1C are cross-sectional views of a conventional label.
Figure 1C:
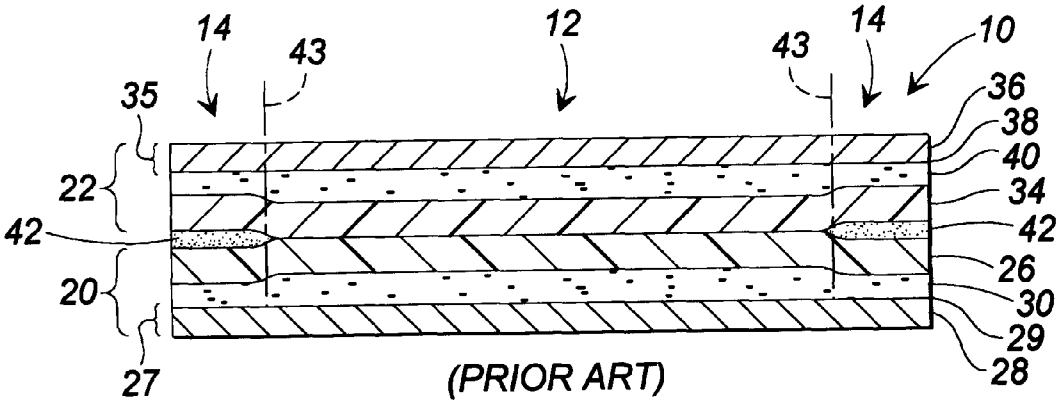
(PRIOR ART) FIG. 1C
Figure 1A:
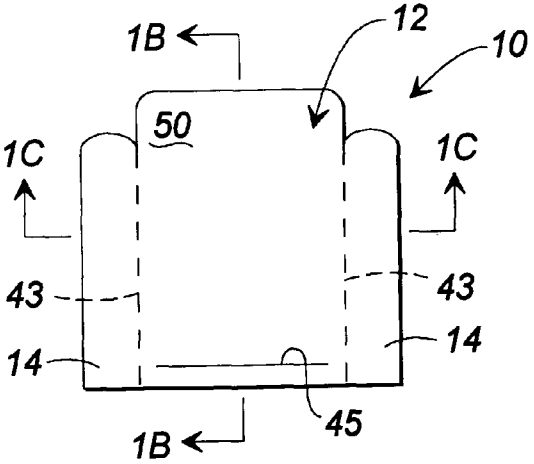
(PRIOR ART) FIG. 1A
Figure 2C:
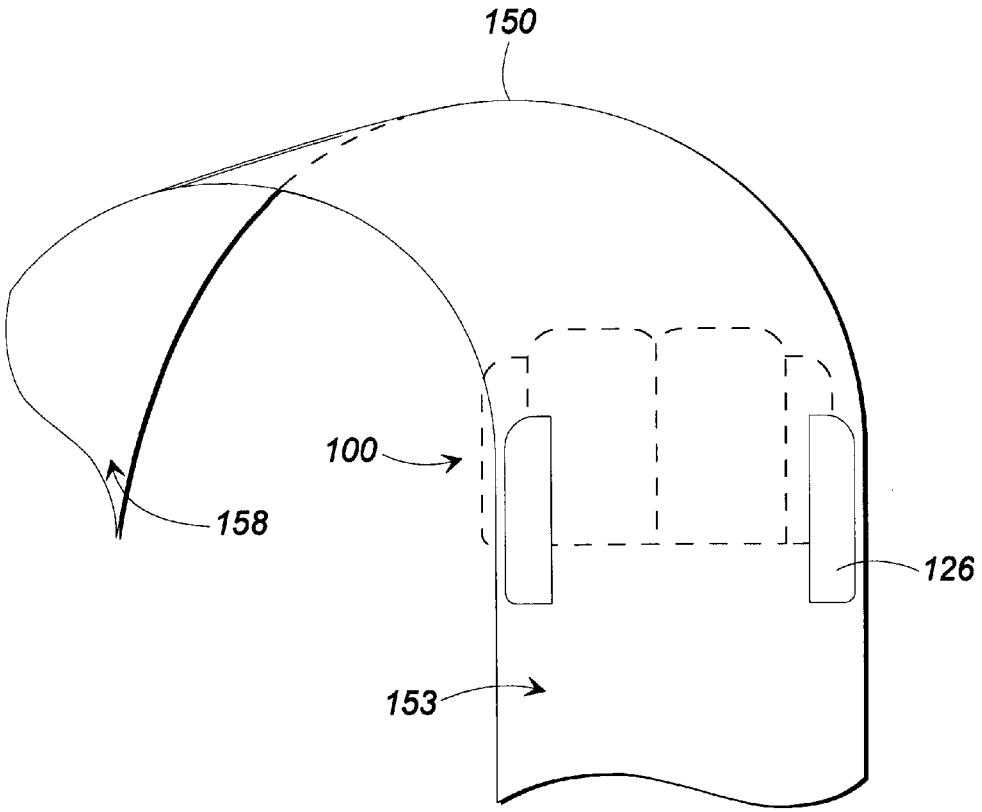
FIG. 2C is a diagram of the label according to the first embodiment of the invention on a release liner.
Figure 2A:
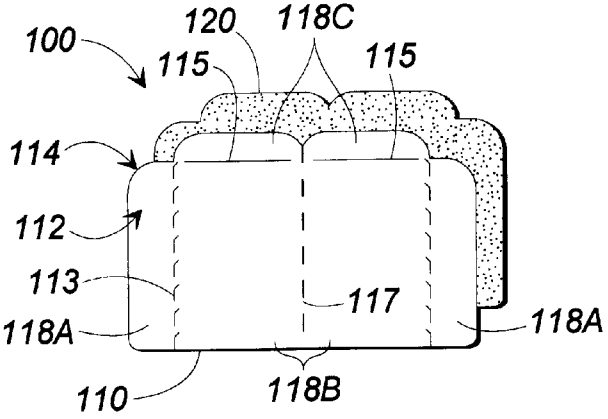
FIG. 2A is a front outside view of a label according to a first embodiment of the invention.
Figure 2B:
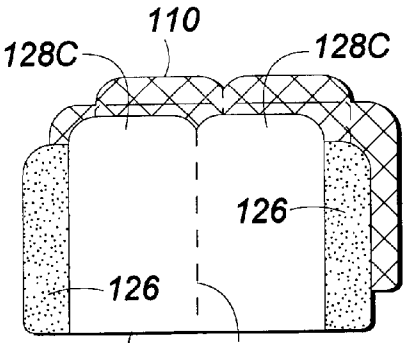
FIG. 2B is a rear inside view of the label according to the first embodiment of the invention.
Figure 2D:
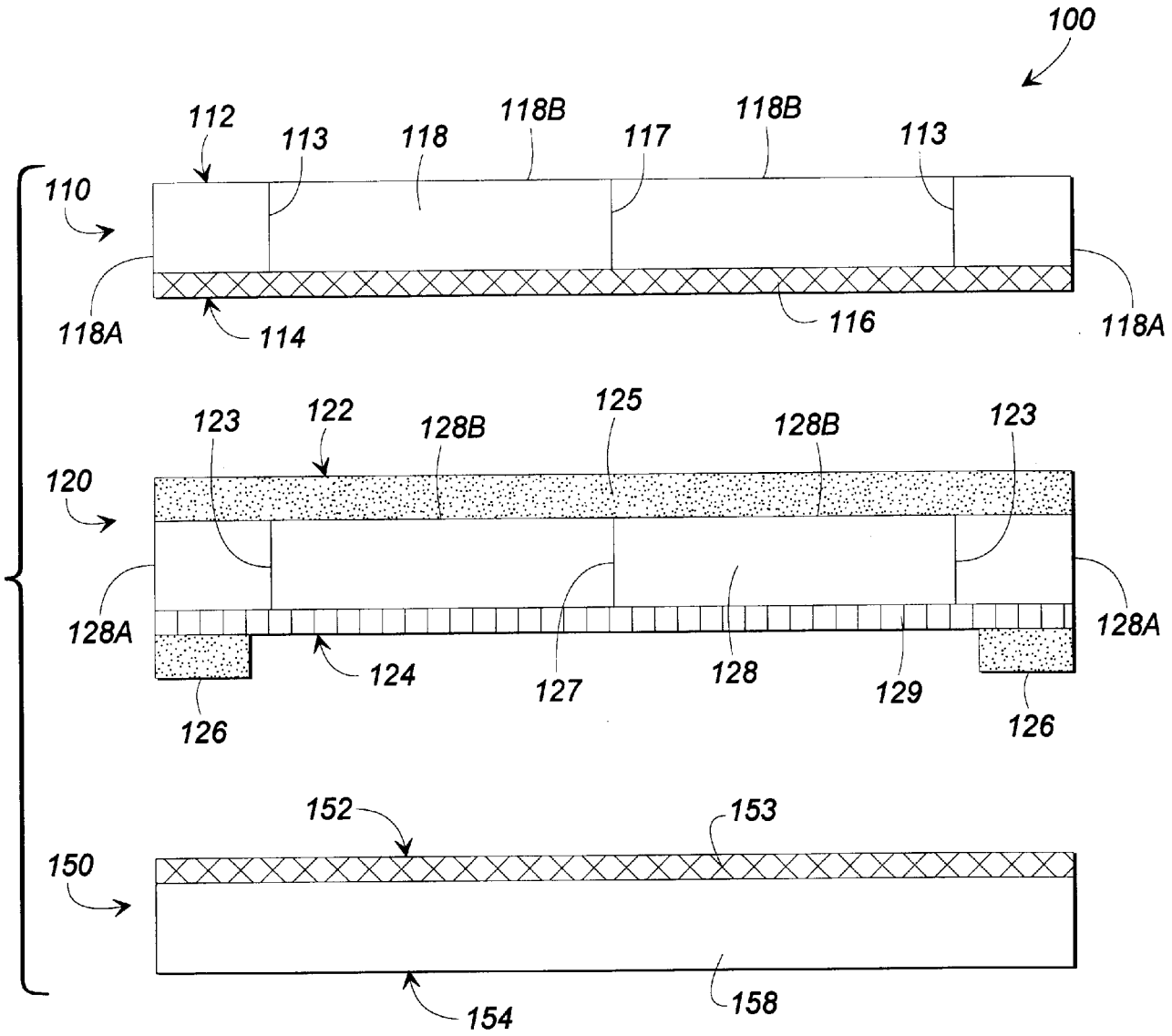
FIG. 2D is a cross-sectional exploded view of the label according to the first embodiment of the invention.

Reference will now be made in detail to preferred embodiments of the invention, nonlimiting examples of which are illustrated in the accompanying drawings. With reference to FIGS. 2A to 2D, a label 100 according to a first embodiment of the invention includes a first layer 110, a second layer 120, and a release layer 150. FIGS. 2A and 2B illustrate outside and inside views of the label 100 as it would be applied to a substrate, such as a beverage cup, FIG. 2C illustrates the label 100 on a web of the release layer 150, and FIG. 2D illustrates an exploded cross sectional view of the label 100.

The first layer 110 of the label 100 is comprised of a layer 118 of paper coated with a release material 116. In the preferred embodiment, the paper layer 118 is formed to have edge sections 118A, center sections 118B, and tab sections 118C. The edge sections 118A are separated from the center sections 118B with perforations 113 and the tab sections 118C are separated from the center sections 118B with slits 115. The paper layer 118 is generally symmetrical about a set of perforations 117 formed in the center of the label 100. The two center sections 118B are separated from each other with the perforations 117. Consumer graphics may be printed on an outer side 112 of the first layer 110 and a confusion pattern may be printed on an inner side 114 of the first layer 110. The outside graphics and the confusion pattern may be printed or otherwise applied to the first layer 110 in any suitable manner, such as with a four color printing process.

The second layer 120 has a shape and size approximately equal to that of the first layer 110. The second layer 120 is comprised of a layer 128 coated on an outer side 122 with a repositionable adhesive 125. An inner side 124 of the layer 128 has adhesive rails 126 which have been zone-coated to the layer 128. The paper layer 128 also includes a set of perforations 123 generally aligned with the perforations 113 and a set of perforations 127 generally aligned with perforations 117 in the first layer 110. The perforations 123 in the paper layer 128 define edge sections 128A of the second layer 120 and the perforations 127 separate and define two center sections 128B. The second layer 120 also includes a pair of tab sections 128C generally aligned with the tab sections 118C of the first layer 110. The inner side 124 of the center sections 128B contains information, such as game indicia, and forms the game piece or collectable component of the label 100. The inner side 124 of the paper layer 128 preferably contains an ink jet image from a variable data printer and the image is preferably sealed with a protective coating 129. The adhesive rails 126 are preferably contained within the edge sections 128A and do not extend into any part of the center sections 128B. The adhesive rails 126, furthermore, are preferably spaced a small distance from the perforations 123.

The release layer 150 is comprised of a paper layer 158 having an outer side 152 coated with a release material 153. An inner side 154 of the paper layer 158 is preferably printed or imaged with a confusion pattern in order to obscure the inner side 124 of the paper layer 128. As shown in FIG. 2C, the label 100 may be releasably secured to the release layer 150 with the adhesive rails 126. A series of labels 100 may be secured along the length of the layer 150.

In use, the label 100 according to a preferred embodiment of the invention is removed from the layer 150 and is secured to a substrate, such as a beverage cup, with the adhesive rails 126. The collectable components 128B are then removed from the substrate, such as by a purchaser of the substrate, by pulling on the tab sections 118C and 128C in order to separate the center sections 118B and 128B from the edge sections 118A and 128A. The perforations 113 and 123 assist in the separation of the center sections 118B and 128B from the edge sections 118A and 128A. The first layer 110 remains attached to the second layer 120 through the repositionable adhesive layer 125.

The two layers 110 and 120 may be detached from each other and may be reattached to each other according to the desires of the user. After the center sections 118B and 128B have been removed from the substrate and from their adjoining edge sections 118A and 128A, the user or purchaser is able to view the inner side 124 of the second layer 120 and is able to view the graphics or image forming the collectable components 128B of the label 100. The user may transport the center sections 128B and 118B or the user may separate the center sections 128B and 118B from each other. After the center sections 128B have been removed from the center sections 118B, the user may secure the center sections 128B to another substrate, such as a game board. Because the center sections 128B are coated with the repositionable adhesive 125, the user is able to releasably secure the sections 128B to other items or substrates, such as to and from a game board or to and from the center sections 118B. Also, the user may separate the center sections 128B from each other along perforations 127 and may secure one of the sections 128B to a substrate independently of the other section 128B.

In the preferred embodiment, the paper layers 118, 128, and 158, comprise paper stock of a 40 to 60 pound range. The release materials 116 and 153 comprise a silicon coating or any solvent-based polyamide resin coating. The repositionable adhesive 125 preferably comprises a pressure sensitive adhesive coating and the adhesive rails 126 comprise polyvinyl acetate water-based dispersion emulsion, ethylene vinyl acetate emulsion, or polyvinyl acrylic co-polymer emulsion.

The label 100 according to the invention offers several advantages over conventional labels. For instance, it does not have an adhesive applied to the entire inner side 124 of the paper layer 128 but rather employs adhesive rails 126 which have been zone-coated within edge sections 128A. By eliminating the amount of adhesive applied to the inner side 124 of the center sections 128B, the label 100 substantially reduces the amount of adhesive used and, consequently, can be manufactured more economically. The label 100 is less expensive and is still consumer friendly. The perforations 113, 117, 123, and 127 allow the consumer to remove the collectable component from a substrate easily without tearing the label 100. Once removed, the consumer may separate the collectable components 128B from the first layer 110 and may secure the collectable components 128B to another substrate, such as a game board. Because the collectable components 128B are coated with a repositionable adhesive, the consumer can selectively secure the collectable components 128B to another substrate or to the first layer 110.

Another significant advantage of the label 100 is that it is comprised of only two layers of paper 118 and 128. Some conventional labels, in contrast, are comprised of three layers with a bottom layer being a "down sheet" that is secured to the substrate. The upper two layers are those layers which are then removed from the substrate and which contain a game piece. The label 100 according to the invention eliminates this entire down sheet and eliminates its associated cost and waste. The cost and waste is not limited to just the down sheet itself since the upper two layers of the conventional label are secured to the down sheet with an adhesive, such as a pressure sensitive adhesive. The label 100 according to the invention therefore eliminates the cost and waste associated with the down sheet and the upper two layers of the conventional label.

The label 100 is not limited to the materials described above. The label 100, for instance, may be comprised of other paper stocks, release materials, or adhesives. Furthermore, although the collectable component has been shown as two center sections 128B, the label may include only a single collectable component or may include an additional number of collectable components, which may be separated from each other with perforations. The label 100 may also include additional fields of adhesive, such as for securing tab sections 118C to tab sections 128C. These additional fields of adhesive may be added to thwart efforts to compromise the hidden features of the label.

Figure 3C:
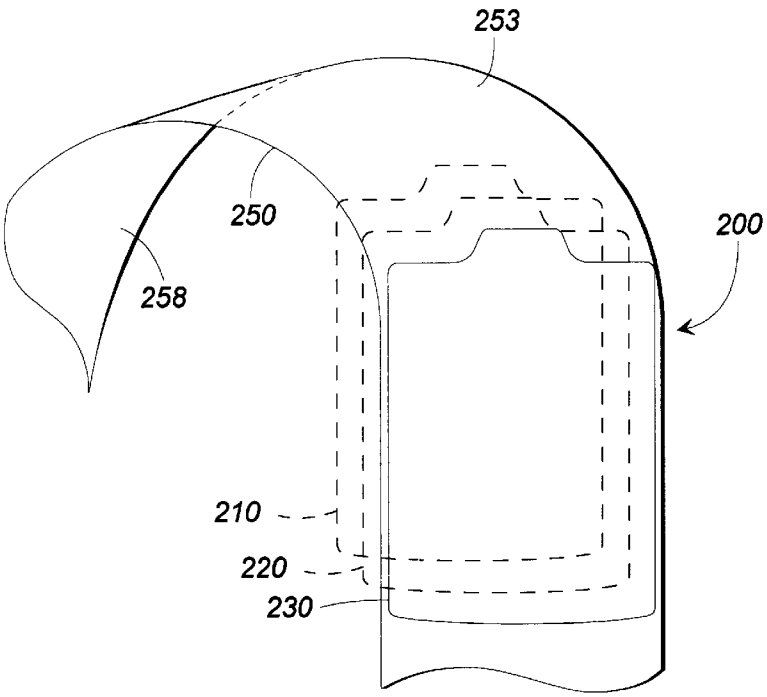
FIG. 3C is a diagram of the label according to the second embodiment of the invention on a release liner.
Figure 3A:
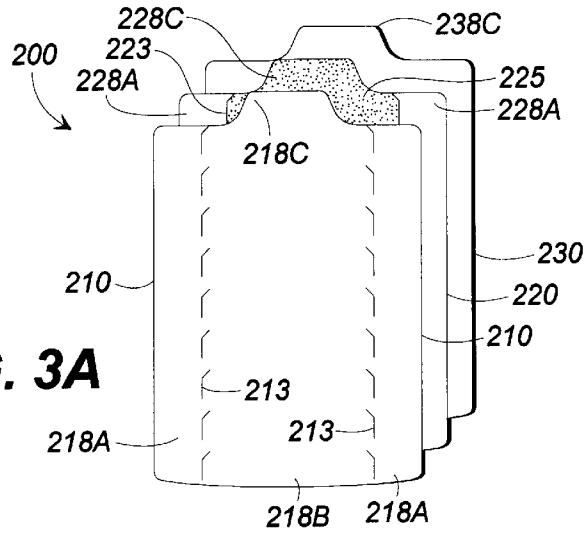
FIG. 3A is a front outside view of a label according to a second embodiment of the invention.
Figure 3B:
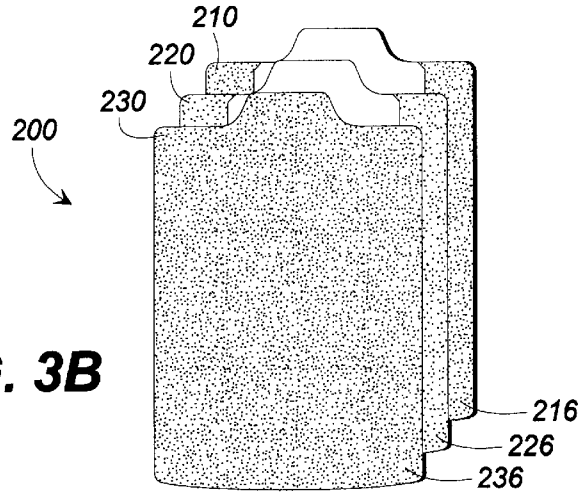
FIG. 3B is a rear inside view of the label according to the second embodiment of the invention.
Figure 3D:
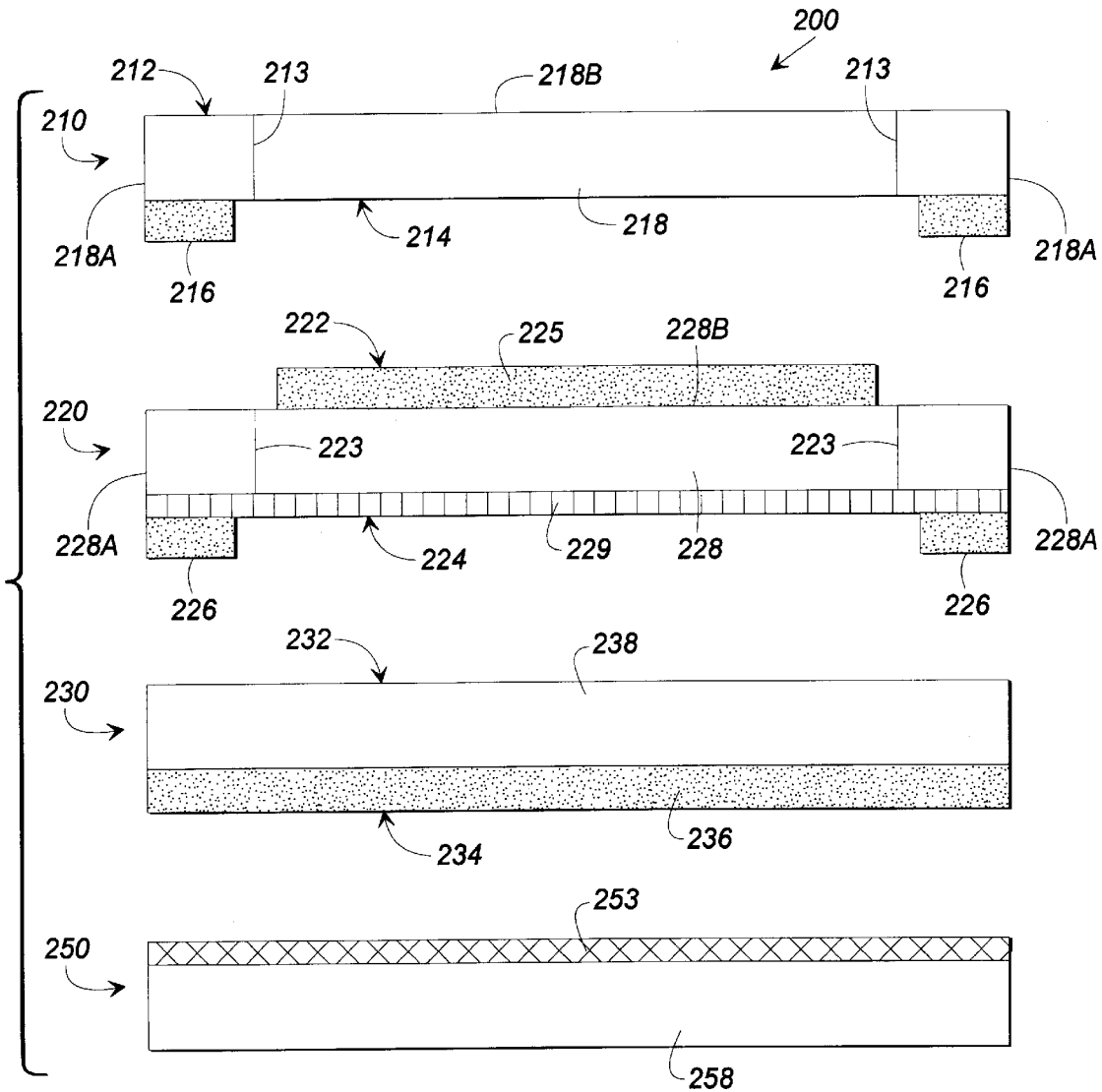
FIG. 3D is a cross-sectional exploded view of the label according to the second embodiment of the invention.

A label 200 according to a second embodiment of the invention is shown in FIGS. 3A to 3D. The label 200 is comprised of four layers: a first layer 210, a second layer 220, a third layer 230, and a release layer 250. FIGS. 3A and 3B illustrate outside and inside views of the label 200 as it would be applied to a substrate, FIG. 3C illustrates the label 200 on a web of the release layer 250, and FIG. 3D illustrates an exploded cross-sectional view of the label 200.

The first layer 210 of the label 200 is formed of a layer 218 of paper having adhesive rails 216 applied to its inner side 214. The paper layer 218 is formed with edge sections 218A, a center section 218B, and a tab section 218C. The edge sections 218A are separated from the center section 218B with two rows of perforations 213. Both an outer side 212 and the inner side 214 of the paper layer 218 may be printed or imaged with graphics. For instance, the outer side 212 of the layer 218 may contain graphics for a game and the inner side 214 may contain rules for the game with both sides 212 and 214 being printed with a four color printing process.

The second layer 220 comprises a layer 228 of paper stock having edge sections 228A, a center section 228B, and a tab section 228C. Two rows of perforations 223 separate the edge sections 228A from the center section 228B. The shape and size of the second layer 220 is preferably equal to that of the first layer 210.

The second layer 220 includes a remoistenable gum 225 coated on an outer side 222 of the layer 220. An inner side 224 of the second layer 220 forms the collectable component of the label 200 and is preferably formed with a four color printing process. To protect the collectable component, the inner side 224 of the paper layer 228 is coated with a sealant 229. The sealant 229 extends across the entire inner side 224 of the paper layer 228 but may, alternatively, be applied only on the inner side 224 of the center section 228B. A pair of adhesive rails 226 is applied to the inner side 224 of the layer 228 and is preferably contained within the edge sections 228A.

The third layer 230 includes a layer 238 of paper stock coated with a layer 236 of permanent pressure sensitive adhesive. Before the label 200 is applied to a substrate, the label 200 is secured to the release layer 250 formed of a layer 258 of paper stock coated with a release layer 253. The third layer 230 forms a "down sheet" and is preferably comprised of a sixty pound stock of paper. The third layer 230 serves to hide the contents of the collectable component when the label 200 is viewed from its inner side 234.

As shown in FIG. 3C, the label 200 is initially secured to a release layer 250, and a series of labels 200 may be applied to a web of release layer 250. The label 200 is removed from the release layer 250 and applied to another substrate, such as a beverage cup. The adhesive 236 secures the third layer 230 to the substrate and the adhesive rails 216 and 226 secure the first and second layers 210 and 220, respectively, to the third layer 230. To view the contents of the collectable component 228B, the center sections 228B and 218B are removed from the substrate and from their adjoining edge sections 228A and 218A, respectively. If desired, the collectable component 228 may be secured to another substrate, such as a game board, by moistening the remoistenable gum 225.

The label 200 according to the second embodiment of the invention provides several advantages. For one, the label 200 does not employ two complete layers of a pressure sensitive adhesive but rather has a remoistenable adhesive 225. By eliminating this second layer of pressure sensitive adhesive, the layer 200 may be manufactured less expensively. The label 200 is also consumer friendly in that the consumer may moisten the remoistenable gum 225 and secure the collectable component to a game board or other surface. The label 200 also accommodates more printing or graphics due to the use of three layers 210, 220, and 230. The first layer 210 may be printed on both sides with its outer side 212 containing graphics for the game and the inner side 214 containing a set of rules governing the game. The second layer 220 may comprise the collectable component on its inner side 224 and the third layer 230 may have additional printing on its outer side 232.

Figure 4C:
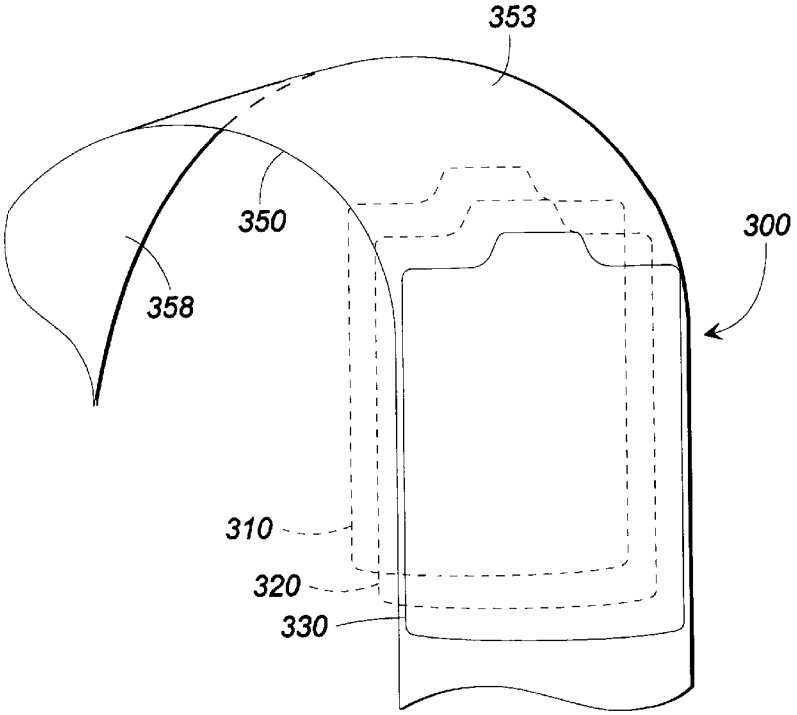
FIG. 4C is a diagram of the label according to the third embodiment of the invention on a release liner.
Figure 4A:
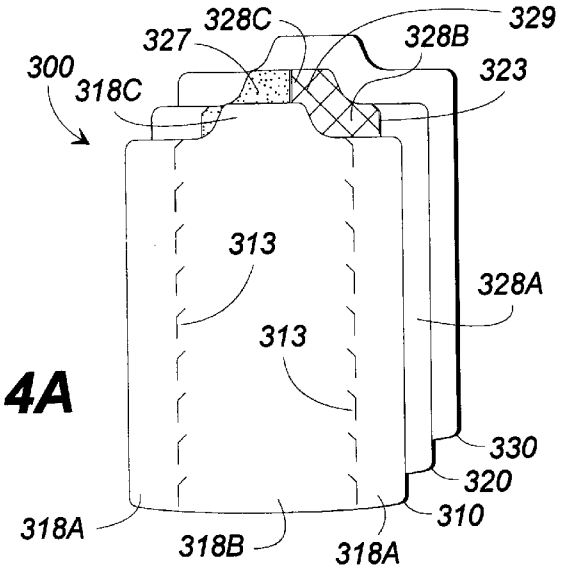
FIG. 4A is a front outside view of a label according to a third embodiment of the invention.
Figure 4B:
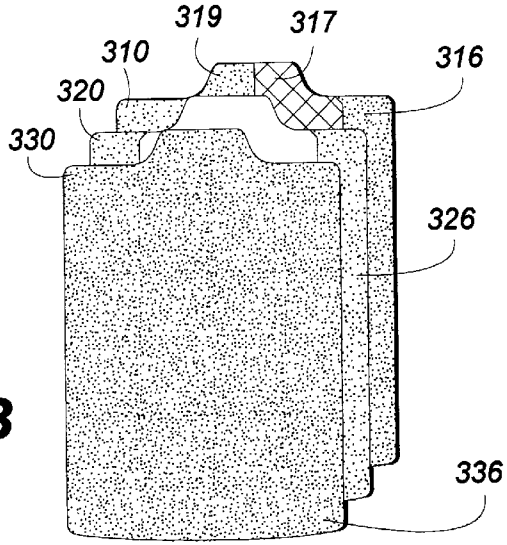
FIG. 4B is a rear inside view of the label according to the third embodiment of the invention.
Figure 4D:
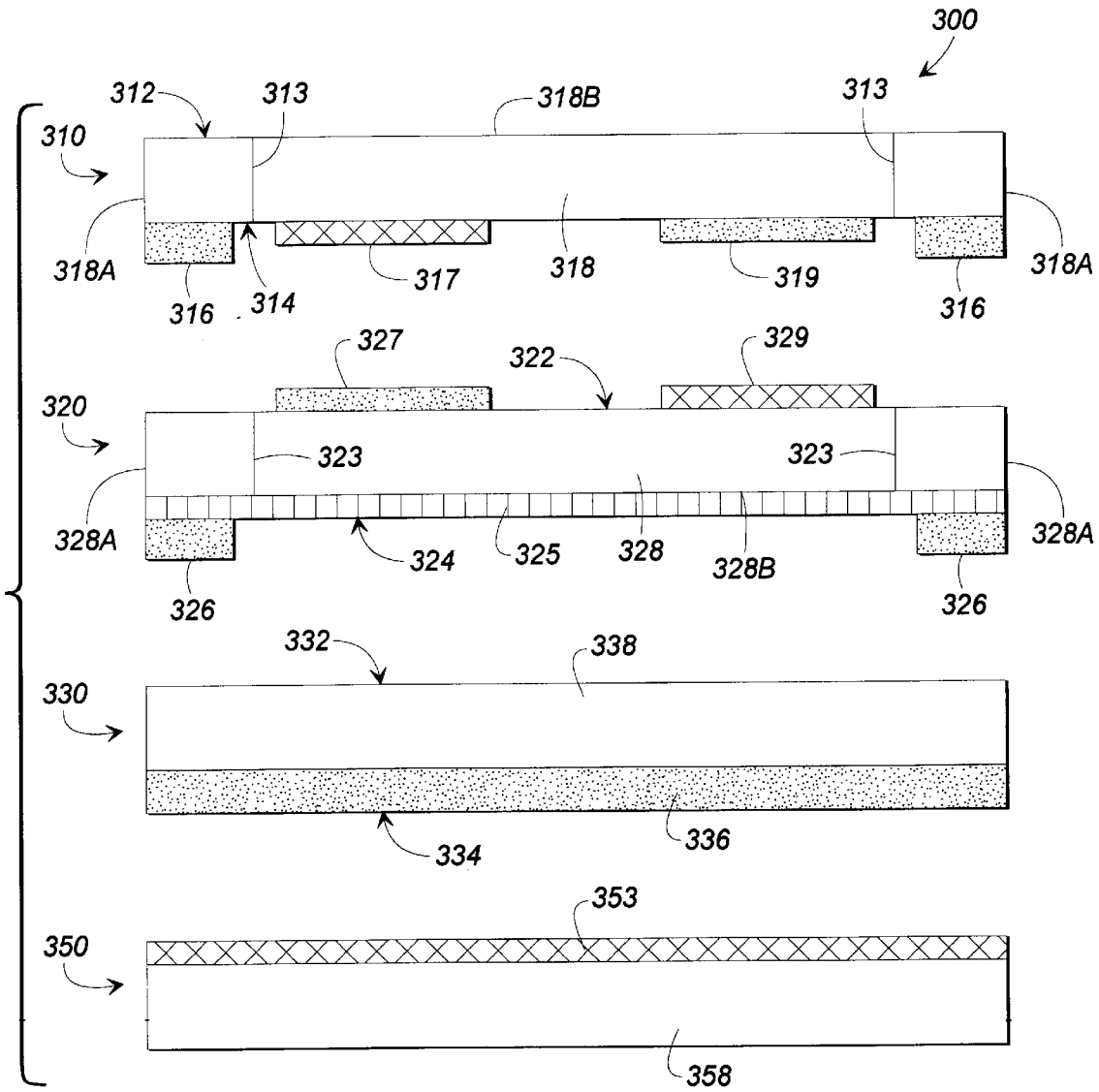
FIG. 4D is a cross-sectional exploded view of the label according to the third embodiment of the invention.

A label 300 according to a third embodiment of the invention is shown in FIGS. 4A to 4D. The label 300 includes a first layer 310, a second layer 320, a third layer 330, and a release layer 350. FIGS. 4A and 4B illustrate outside and inside views of the label 300, FIG. 4C illustrates the label 300 on a web of a release layer 350, and FIG. 4D illustrates an exploded cross-sectional view of the label 300.

The first layer 310 of the label 300 includes a layer 318 of paper stock having adhesive rails 316 applied to its inner side 314 within edge sections 318A. The paper layer 318 is formed with the edge sections 318A, a center section 318B, and a tab section 318C with the edge sections 318A being separated from the center section 318B with two rows of perforations 313. The first layer 310 also includes adhesive rails 316 applied to its inner side 314 with these rails 316 preferably being contained within the edge sections 318A and not extending into the perforations 313. The first layer 310 further includes a spot release 317 applied in one portion on the inner side 314 of the layer 310 and a repositionable adhesive applied 319 in a second portion on the inner side 314 of the layer 310. Preferably, the release 317 and the adhesive 319 are positioned so that when the layer 310 is folded in half the release 317 is aligned with the adhesive 319.

The second layer 320 comprises a layer 328 of paper stock having edge sections 328A, a center section 328B, and a tab section 328C. As with the first layer 310, the second layer 320 includes two rows of perforations 323 for separating the edge sections 328A from the center section 328B. The shape and size of the second layer 320 is preferably equal to that of the first layer 310.

The second layer 320 includes a repositionable adhesive 327 applied to one portion of the outer side 322 of the layer 320 and a spot release 329 applied to a second portion of the outer side 322. The adhesive 327 and the release 329 are preferably positioned so that they are aligned with each other when the layer 320 is folded in half. Furthermore, the release 317 on the first layer 310 is preferably aligned with the adhesive 327 on the second layer 320 and the adhesive 319 on the first layer 310 is preferably aligned with the release 329 on the second layer 320. In this manner, the first and second layers 310 and 320 are releasably secured to each other and, moreover, each of the layers 310 and 320 may be folded in half and releasably secured in that position.

The inner side 324 of the center section 328B preferably comprises the game piece and is printed or imaged with suitable information and is protected with a sealant 325. Although the sealant 325 is shown extending along the entire layer 328, the sealant 325 may be limited to just the center section 328B. The inner side 324 of the second layer 320 also includes a pair of adhesive rails 326 contained within the edge sections 328A.

The third layer 330 of the label 300 includes a layer 338 of paper stock and a layer 336 of permanent pressure sensitive adhesive secured to an inner side 334 of the layer 330. The release layer 350 includes a layer 358 of paper stock and a release layer 353. The third layer 330 is formed of 60 pound stock and acts as a "down sheet" which prevents the collectable component 328B from being seen from its inner side 334.

To remove the collectable component 328B from the substrate, the tab sections 318C and 328C are pulled down thereby tearing the center sections 318B and 328B away from edge sections 318A and 328A, respectively. After the center sections 318B and 328B are removed, the first and second layers 310 and 320 remain attached to each other due to the alignment of the releases 317 and 329 to their respective adhesives 327 and 319. If desired, the collectable component 328B may be removed from the center section 318B and may be secured to another substrate, such as a game board.

Advantageously, the consumer may remove the collectable component 328B from the first layer 310 and fold the component 328B in half with the release 329 aligned with the adhesive 327. The consumer therefore need not have the game board or other type of substrate immediately available once the collectable component 328B has been separated from the first layer 310. The consumer, moreover, need not be inconvenienced with a remoistenable adhesive, such as adhesive 225 in label 200, but instead can enjoy the ease and benefits of a pressure sensitive adhesive.

As with the label 200, label 300 also provides more surface area to accommodate printing or graphics. The first layer 310 may contain graphics on its outer side 312 and may have other information placed on its inner side 314. The second layer 320 preferably contains information for the collectable component on its inner side 324 of the center section 328B. Additional information, such as rules, may be placed on the outer side 332 of the third layer 330.

Figure 5C:
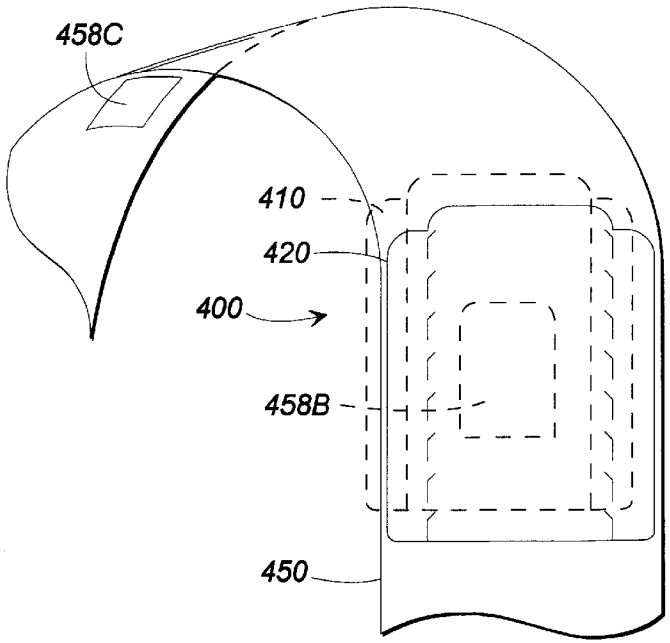
FIG. 5C is a diagram of the label according to the fourth embodiment of the invention on a release liner.
Figure 5B:
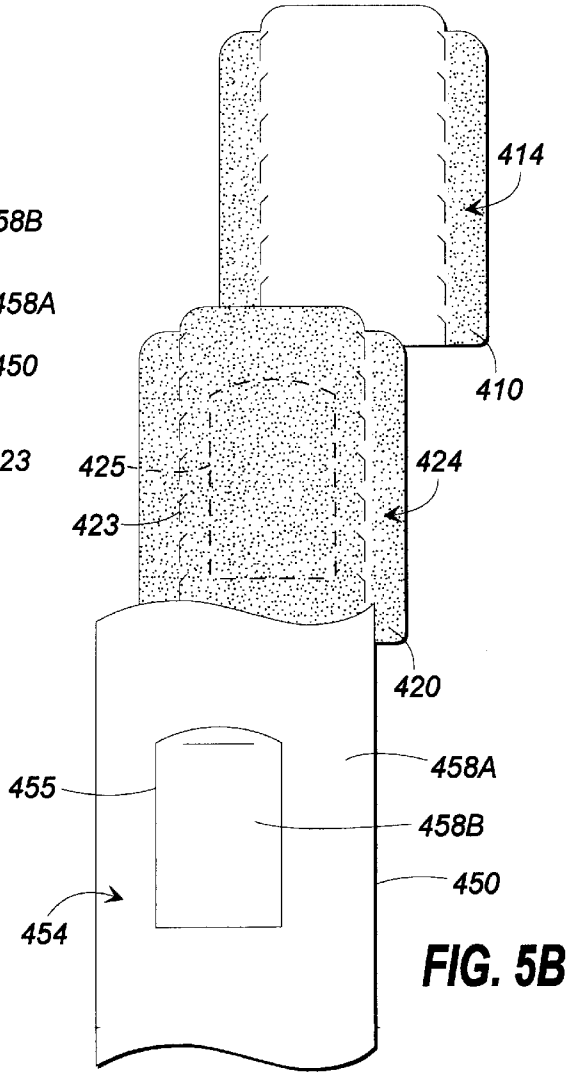
FIG. 5B is a rear inside view of the label according to the fourth embodiment of the invention.
Figure 5A:
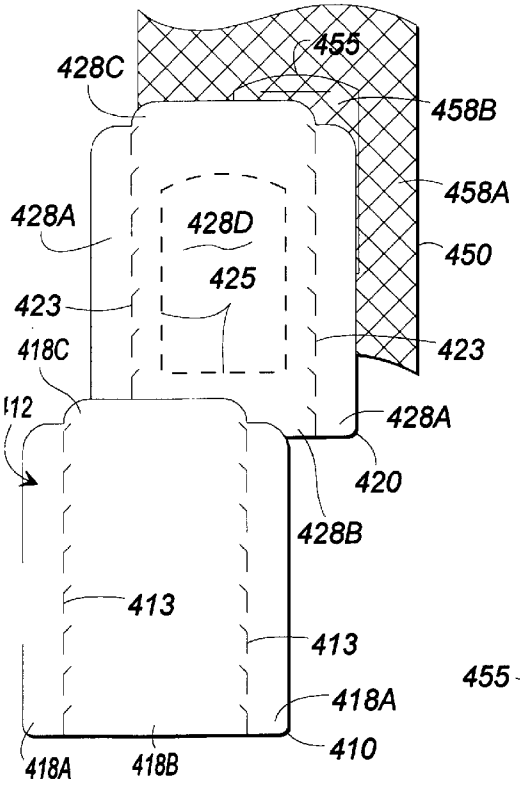
FIG. 5A is a front outside view of a label according to a fourth embodiment of the invention.
Figure 5D:
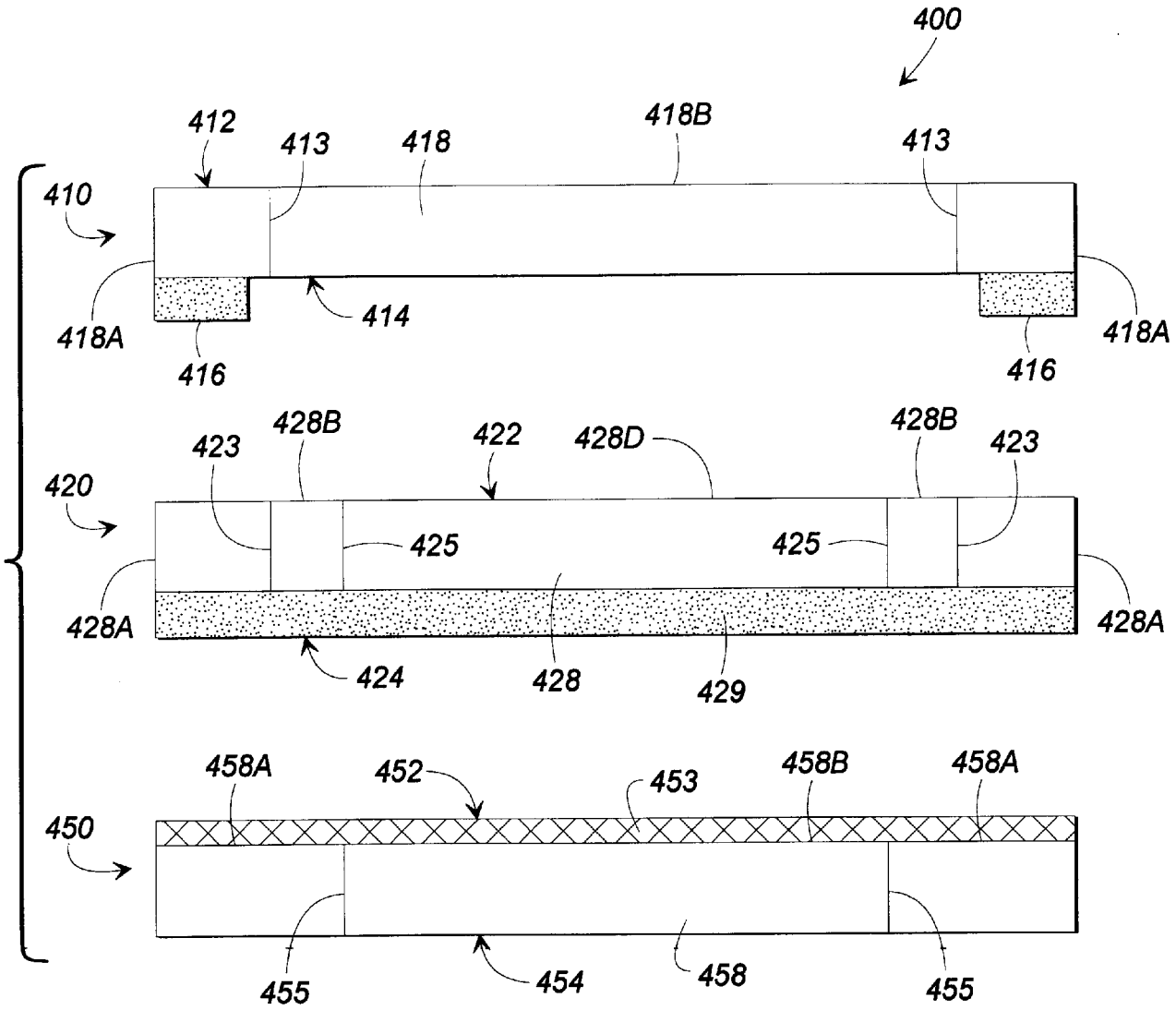
FIG. 5D is a cross-sectional exploded view of the label according to the fourth embodiment of the invention.

A label 400 according to a fourth embodiment of the invention is shown in FIGS. 5A to 5D. The label 400 includes a first layer 410, a second layer 420, and a release layer 450. FIGS. 5A and 5B illustrate outside and inside views of the label 400, FIG. 5C illustrates the label 400 on a web of a release layer 450, and FIG. 5D illustrates an exploded cross-sectional view of the label 400.

The first layer 410 of the label 400 includes a layer 418 of paper stock coated with adhesive rails 416 on its inner side 414. The paper layer 418 contains two rows of perforations 413 for separating the layer 418 into edge sections 418A and a center section 418B. The center section 418B preferably includes a tab section 418C.

The second layer 420 includes a layer 428 of paper coated with a pressure sensitive adhesive 429 on its inner side 424. The paper layer 428 contains two rows of perforations 423 for separating the layer 428 into edge sections 428A and a center section 428B. The center section 428B includes an additional set of perforations 425 for defining an inner section 428D which is to be used as a collectable component. The center section 428B of the second layer 420 preferably includes a tab section 428C.

The release layer 450 includes a layer 458 of paper stock coated on its outer side 452 with a release layer 453. The paper layer 458 is cleanly cut along lines 455 so as to define an inner section 458B and an outer section 458A. The inner section 458B of the release layer 450 is preferably the same size and is aligned with the inner section 428D of the second layer 420.

With reference to FIG. 5C, the first and second layers 410 and 420 are initially placed on the release layer 450 and a plurality of the labels 400 are sequentially placed along a web of the release layer 450. In order to secure the label 400 on a substrate, such as a beverage cup, the first and second layers 410 and 420 are separated from the edge sections 458A of the release layer 450. Since the inner section 458B of the release layer 450 is cleanly cut along lines 455, the inner section 458B remains secured to the second layer 420 as the first and second layers 410 and 420 are separated from the release layer 450. Once the first and second layers 410 and 420 are removed from the release layer 450, the separation of the inner section 458B from the rest of the release layer 450 leaves an aperture 458C in the release layer 450.

The first and second layers 410 and 420 of the label 400 are then applied to the desired substrate along with the inner section 458B of the release layer 450. The pressure sensitive adhesive 429 on the inner side 424 of the paper layer 428 affixes the first and second layers 410 and 420 to the substrate. The adhesive rails 416 ensure that the first layer 410 is secured to the second layer 420. Although the adhesive rails 416 have been shown on the first layer 410, the second layer 420 may have adhesive rails on its outer side 422 contained within the edge sections 428A and these adhesive rails may replace or be used in addition to adhesive rails 416.

After the first and second layers 410 and 420 of the label 400 have been applied to the substrate, the collectable component 428D of the label 400 may be viewed by pulling down on tab section 418C and removing the center section 418B of the first layer 410. In the preferred embodiment, game indicia is printed or imaged on the outer side 422 of the second layer 420. Thus, with the center section 418B of the first layer 410 removed, the game indicia may be readily viewed. To remove the collectable component 428D from its attached substrate, the inner section 428D of the second layer 420 is then pried or otherwise removed from the rest of the center section 428B and, in doing so, the inner section 428D would be removed with its associated liner formed by the inner section 458B of the release layer 450. The release liner 458B may be removed from the collectable component 428D at a desired time and placed on another substrate, such as a game board.

The label 400 according to the fourth embodiment of the invention offers a number of advantages over conventional labels. The label 400, for instance, reduces waste by having only two paper layers 418 and 428 applied to a substrate. The label 400 may have graphics printed on an outer side 412 of the first layer 410 and may place game indicia or rules on an inner side 414 of the first layer 410. The second layer 420, as discussed above, preferably contains game indicia on its outer side 422 of the inner section 428D. In addition to reducing waste, the label 400 has a reduced cost due to the elimination of the third layer and also due to the use of only one complete layer of adhesive. The label 400 still maintains a high level of consumer friendliness in that it has a pressure sensitive adhesive 429 and release liner 458B attached to the inner side 424 of the collectable component 428D, thereby allowing the consumer to secure the collectable component 428D to another substrate at the consumer's convenience.

The layers of the labels applied to a substrate are preferably the same size and shape and are aligned with each other but may, alternatively, have varying shapes and sizes. The second layers, for instance, may not contain a tab section or, conversely, the first layers may not have the tab sections. Other variations in the shape and sizes of the layers in the labels according to the invention are possible.

The labels according to the invention have been described primarily with reference to games or other promotions. The labels, however, are not limited to just games or promotions and the collectable components may contain information other than game indicia.

In the exemplary embodiments described above, the labels have been printed or imaged with certain information, such as rules, consumer graphics, and game indicia. The invention is not limited to any specific type of information and, moreover, may be applied in any suitable manner. The information, for example, may be printed onto a layer of the label, may be imaged, or may be applied in any other manner or process.

The invention, furthermore, is not limited to any specific set of materials but may be formed with any suitable set of materials. The layers of paper, for instance, may be formed of any suitable paper stock or, alternatively, may be formed of other cellulosic materials or materials that share some properties of paper stock or other cellulosic materials. The sealant coatings are preferably a solvent based vinyl coating but may encompass other suitable coatings. In the preferred embodiments, the permanent pressure sensitive adhesive includes all temperature emulsion acrylic adhesives designed to adhere to a wide variety of materials. The removable pressure sensitive adhesive includes pressure-sensitive, general purpose, removable emulsion acrylic adhesives designed with moderate initial tack and consistency of adhesion and clean removability over long periods of time on a wide range of substrates. The repositionable adhesives include all modified pressure-sensitive vinyl acetate/vinyl acrylate co-polymer emulsion and the rail adhesives include mixtures of polyvinyl acetate water-based dispersion emulsion, ethylene vinyl acetate emulsion, or polyvinyl acrylic copolymer emulsion. The remoistenable adhesive includes blends of polyvinyl acetate water-based dispersion emulsion or ethylene vinyl acetate emulsion mixed with polyvinyl alcohol. As for inks, gravure inks include solvent based acrylic resin/nitro cellulose dispersion systems and offset inks include phenolic, hydrocarbon resins based/flushed pigments. Again, the materials listed above are preferred materials but may be substituted for other suitable materials.

While the foregoing specification teaches the principles of the present invention, with examples provided for the purpose of illustration, it will be understood that the practice of the invention encompasses all of the usual variations, adaptations, or modifications, as come within the scope of the following claims and their equivalents.

We claim:

1. A label having a collectable component, comprising:

a first layer having a first central section and a first pair of edge sections disposed on either side of the first central section with the first pair of edge sections being separable from the first central section along first and second rows of perforations;

a second layer having a second central section and a second pair of edge sections disposed on either side of the second central section with the second pair of edge sections being separable from the second central section along third and fourth rows of perforations, an inner side of the second edge section forming the collectable component;

an adhesive coating applied to an outer side of at least a first portion of the second central section;

a release coating applied to an inner side of at least a second portion of the first central section, the release coating covering the adhesive coating when the first layer is releasably secured to the second layer; and first and second adhesive rails applied to an inner side of the second pair of edge sections for securing the first and second layers to a substrate;

wherein the collectable component is removed from the substrate by removing the first and second central sections from the first and second pairs of edge sections, respectively, and the collectable component is secured to a second substrate by separating the first central section from the second central section so that the adhesive coating on the outer side of the second central section is exposed.

2. The label as set forth in claim 1, further comprising a third layer having a release coating, the first and second layers being releasably secured to the third layer with the adhesive coating and being separated from the third layer before being applied to the substrate.

3. The label as set forth in claim 1, wherein the second central section comprises two second central sections separable from each other with a fifth row of perforations.

4. The label as set forth in claim 1, wherein the adhesive coating is a pressure sensitive adhesive.

5. The label as set forth in claim 1, wherein the first central section includes a slit for use in separating the first central section from the second central section.

6. The label as set forth in claim 1, wherein the first and second central sections include first and second tab sections protruding beyond the first and second pairs of edge sections, respectively.

7. The label as set forth in claim 1, further comprising a sealant coating applied to the inner side of the second layer for protecting the collectable component.

8. A label having a collectable component, comprising:

a first layer having a first central section and a first pair of first edge sections disposed on either side of the first central section with the first pair of edge sections being separable from the first central section with first and second rows of perforations;

a second layer having a second central section and a second pair of second edge sections disposed on either side of the second central section with the second pair of edge sections being separable from the second central section with third and fourth rows of perforations, an inner side of the second central section forming the collectable component;

a third layer;

a first adhesive coating applied to an inner side of the third layer for securing the third layer to a substrate;

a first pair of adhesive rails placed on an inner side of the second pair of edge sections for securing the second layer to the third layer;

a second pair of adhesive rails placed on an inner side of the first pair of edge sections for securing the first layer to the second layer; and a second adhesive coating applied to at least a portion of an outer side of the second central section;

wherein the collectable component is removed from the substrate by removing the first and second central sections from the first and second pairs of edge sections, respectively, and the collectable component is secured to a second substrate with the second adhesive coating.

9. The label as set forth in claim 8, wherein the first and second central sections include first and second tab sections protruding beyond the first and second central sections, respectively.

10. The label as set forth in claim 8, further comprising a fourth layer having a release coating, the first, second, and third layers being releasably secured to the fourth layer with the first adhesive coating and being separated from the fourth layer before being applied to the substrate.

11. The label as set forth in claim 8, wherein the outer side of the third layer forms a confusion pattern.

12. The label as set forth in claim 8, wherein the first adhesive coating is a pressure sensitive adhesive.

13. The label as set forth in claim 8, wherein the second adhesive coating is a remoistenable adhesive.

14. The label as set forth in claim 8, wherein the second adhesive coating is a pressure sensitive adhesive.

15. The label as set forth in claim 14, further including a first release coating applied to an inner side of the first layer and aligned with the second adhesive coating.

16. The label as set forth in claim 15, further including a second release coating applied to the outer side of the second central section and a third adhesive coating applied to an inner side of the first central section and aligned with the second release coating.

17. The label as set forth in claim 15, wherein the second adhesive coating and the second release coating are applied to the outer side of the second central section so that the second central section may be folded onto itself with the second adhesive coating aligned and covered by the second release coating.

18. The label as set forth in claim 8, further comprising sealant coating applied to the inner side of the second layer for protecting the collectable component.

19. A label having a collectable component, comprising:

a first layer having a first central section and a first pair of first edge sections disposed on either side of the first central section with the first pair of edge sections being separable from the first central section with first and second rows of perforations, an inner side of the first central section forming the collectable component;

a second layer having a second central section and a second pair of second edge sections disposed on either side of the second central section with the second pair of edge sections being separable from the second central section with third and fourth rows of perforations;

a third layer for being positioned against the inner side of the second central section and being sized no greater than the second central section;

a pair of adhesive rails for securing the first pair of edge sections to the second pair of edge sections;

an adhesive coating applied to an inner side of the second layer for securing the second layer to a substrate; and a release coating applied to an outer side of the third layer for releasably securing the third layer to the second central section;

wherein the collectable component is removed from the substrate by separating the first and second central sections from the first and second pairs of edge sections, respectively, and the collectable component is secured to a second substrate by removing the third layer from the inner side of the second central section to expose the adhesive coating.

20. The label as set forth in claim 19, wherein the third layer is positioned only under a portion of the second central section.

21. The label as set forth in claim 19, wherein the second central section includes a set of perforations for defining an inner section to the central section, the inner section forming the collectable component of the label.

22. The label as set forth in claim 21, wherein the third layer is secured to the second central section and is aligned with the inner section.

23. The label as set forth in claim 19, wherein the third layer comprises part of a release layer.

24. The label as set forth in claim 19, wherein the adhesive coating comprises a pressure sensitive adhesive.

* * * * *